US008043029B2

(12) United States Patent
Kim

(10) Patent No.: US 8,043,029 B2
(45) Date of Patent: Oct. 25, 2011

(54) PACKER STRUCTURE

(76) Inventor: Chen Man Kim, Buford, GA (US)

( * ) Notice: Subject to any disclaimer, the term of this patent is extended or adjusted under 35 U.S.C. 154(b) by 219 days.

(21) Appl. No.: 12/503,005

(22) Filed: Jul. 14, 2009

(65) Prior Publication Data

US 2010/0092248 A1 Apr. 15, 2010

(30) Foreign Application Priority Data

Oct. 10, 2008 (KR) ..... 10-2008-0099562
Jun. 8, 2009 (KR) ..... 10-2009-0050523

(51) Int. Cl.
*E04G 23/02* (2006.01)
*E02D 37/00* (2006.01)

(52) U.S. Cl. ..... 405/269; 405/266

(58) Field of Classification Search ..... 405/266, 405/267, 269
See application file for complete search history.

(56) References Cited

U.S. PATENT DOCUMENTS 4,555,286 A * 11/1985 Orikasa et al. ..... 156/94
4,555,295 A * 11/1985 Orikasa et al. ..... 156/94
4,986,862 A * 1/1991 Matsufuru ..... 156/94
5,809,736 A * 9/1998 Naito et al. ..... 52/742.14
5,881,523 A * 3/1999 Quatrochi, Jr. ..... 52/742.16
5,948,444 A * 9/1999 Naito et al. ..... 425/13

FOREIGN PATENT DOCUMENTS

JP 1985-108652 A 7/1985
JP 10306594 A * 11/1998
JP 2010090695 A * 4/2010
KR 83-4508 A 7/1983
KR 20-0222509 Y1 5/2001
KR 2002-0073119 A 9/2002

* cited by examiner

*Primary Examiner* — Frederick L Lagman
(74) *Attorney, Agent, or Firm* — Kile Park Goekjian Reed & McManus PLLC

(57) ABSTRACT

A packer structure for grouting injects a repair liquid into a crack of a concrete structure. The packer structure includes a packer body having a flange adhered onto the crack and a central tube extending upwards from a central portion of the flange, an elastic tube having a first end connected to a first coupling portion of the central tube, a repair liquid injecting tube having a second coupling portion connected to a second end of the elastic tube and a check valve coupled to the repair liquid injecting tube and preventing the repair liquid from flowing backward; a first coupling cap having an inner circumference surface of a lower portion screwed to the central tube, and a second coupling cap having an inner circumference surface of an upper portion screwed to the repair liquid injecting tube.

4 Claims, 6 Drawing Sheets

PACKER STRUCTURE

CROSS-REFERENCE TO RELATED PATENT APPLICATION

This application claims the benefit of Korean Patent Application Nos. 10-2008-0099562 and 10-2009-0050523, filed on Oct. 10, 2008 and Jun. 8, 2009, respectively, in the Korean Intellectual Property Office, the disclosures of which are incorporated herein in its entirety by reference.

BACKGROUND OF THE INVENTION

1. Field of the Invention

The present invention relates to a packer structure for grouting and having an elastic tube, and more particularly, to a packer structure for grouting, in which both ends of the elastic tube are easily and strongly pressurized and coupled.

2. Description of the Related Art

Generally, when a concrete structure is dried to shrink, or a change in temperature or a water leakage occurs in the concrete structure, cracks may be easily generated on or in the concrete structure.

In a place onto which a significant load acts (e.g., the bottom of an underground parking lot), or a slab bottom having waterproof and finish concrete layers that are not well processed, event if cracks are not exposed out of a concrete structure, cracks may frequently separate the finish concrete layer from the concrete structure.

Moisture and air may easily penetrate into cracks generated in the above-described concrete structure, and the concrete structure may be easily weathered due to moisture and air penetrating into the cracks. Thus, iron reinforcing rods of the concrete structure may corrode, thereby seriously adversely affecting the lifetime and stability of the concrete structure.

A packer structure has been used to grout cracks generated in concrete structures. The present invention includes improvements on the conventional packer structure.

SUMMARY OF THE INVENTION

The present invention provides a packer structure for grouting and having an elastic tube, in which the elastic tube is easily and strongly coupled in order to prevent a repair liquid from leaking from both ends of the elastic tube.

According to an aspect of the present invention, there is provided a packer structure for grouting which is used to inject a repair liquid into a crack of a concrete structure, the packer structure including: a packer body including: a flange adhered onto the crack by a sealer, wherein a groove portion accommodating the sealer is formed on a lower surface of the flange; and a central tube that is a hollow tube extending upwards from a central portion of the flange, wherein a first coupling portion is formed at an upper portion of the central tube, has an external circumference that decreases upwards, and includes a first inclined surface; and an elastic tube having a first end connected to the first coupling portion, wherein the elastic tube inflates and deflates elastically, a repair liquid is contained in the elastic tube while the elastic tube inflates, and the repair liquid is injected into the crack by a deflation force; a repair liquid injecting tube including: a second coupling portion connected to a second end of the elastic tube, having an external circumference that decreases downwards, and including a second inclined surface; a check valve coupled to the repair liquid injecting tube and preventing the repair liquid from flowing backward; a first coupling cap having an inner circumference surface of a lower portion screwed to the central tube, wherein a first pressurizing surface is formed on an inner circumference surface of an upper portion of the first coupling cap so as to pressurize the elastic tube towards the first inclined surface; and a second coupling cap having an inner circumference surface of an upper portion screwed to the repair liquid injecting tube, wherein a second pressurizing surface is formed on an inner circumference surface of a lower portion of the second coupling cap so as to pressurize the elastic tube towards the second inclined surface.

The check valve may include a stumbling projection having a circular shape and formed on an inner circumference surface of the injecting hole; and an elastic plate that is separately inserted into an insertion hole connected to the injecting hole, is formed below an outer circumference surface of the stumbling projection, and is elastically changed so as to close and open the injecting hole.

The elastic plate may include an insertion portion inserted into the insertion hole and a stumbling portion stumbled over an outer circumference surface of the injecting hole, and the stumbling projection may include a grasping groove for grasping the stumbling portion.

The packer structure may further include a prevention projection formed on a lower surface of the flange 12 and preventing the sealer from penetrating into the expansion space.

The packer structure may further include a plurality of through holes formed at an edge of the flange in a circumferential direction of the flange, wherein the sealer passes through the plurality of through holes, and each of the plurality of through holes may include a third inclined surface tapered away from the concrete structure so that an outer circumference surface of each of the plurality of through holes increases towards the concrete structure.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
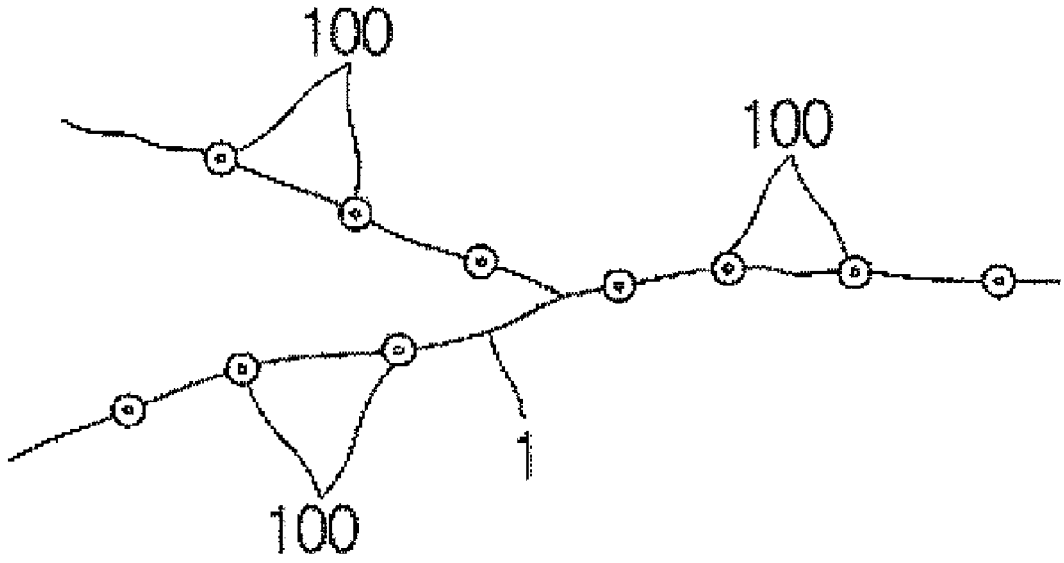
FIG. 1 is a diagram for explaining a state where a packer structure for grouting is installed on a concrete structure, according to an embodiment of the present invention.

FIG. 1 is a diagram for explaining a state where a packer structure for grouting is installed on a concrete structure, according to an embodiment of the present invention.

Referring to FIG. 1, the packer structure 100 is adhered onto a crack 1 of the concrete structure to inject a repair liquid into the crack 1, and more particularly, to used to press both ends of an elastic tube.

Figure 2:
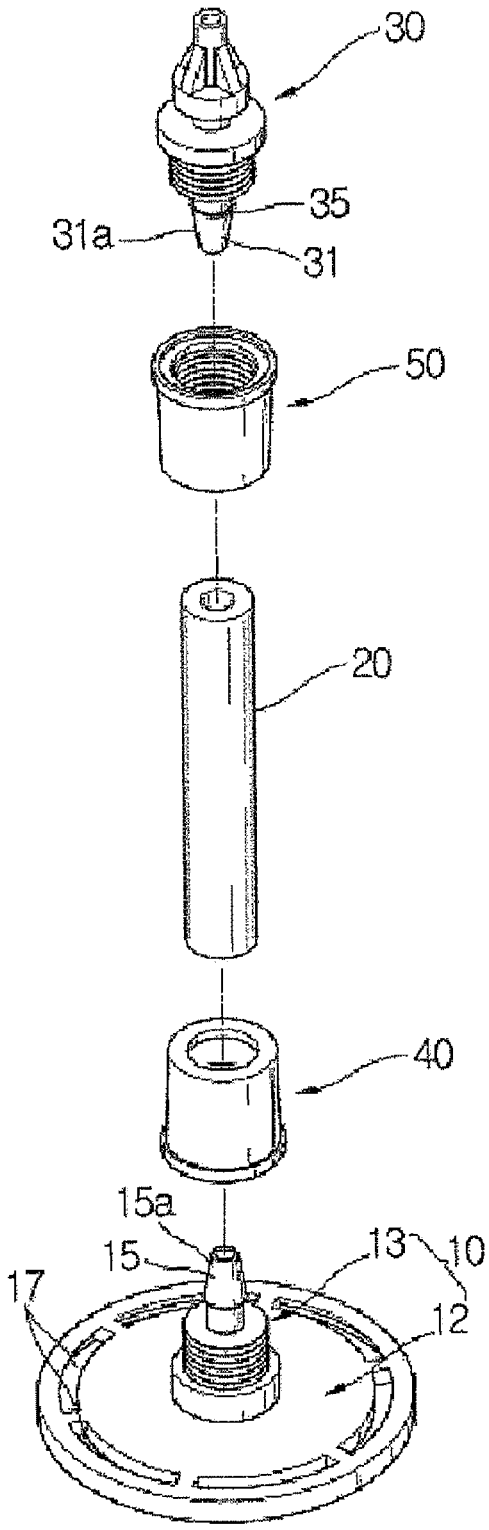
FIG. 2 is an exploded perspective view of a packer structure for grouting according to an embodiment of the present invention.
Figure 3:
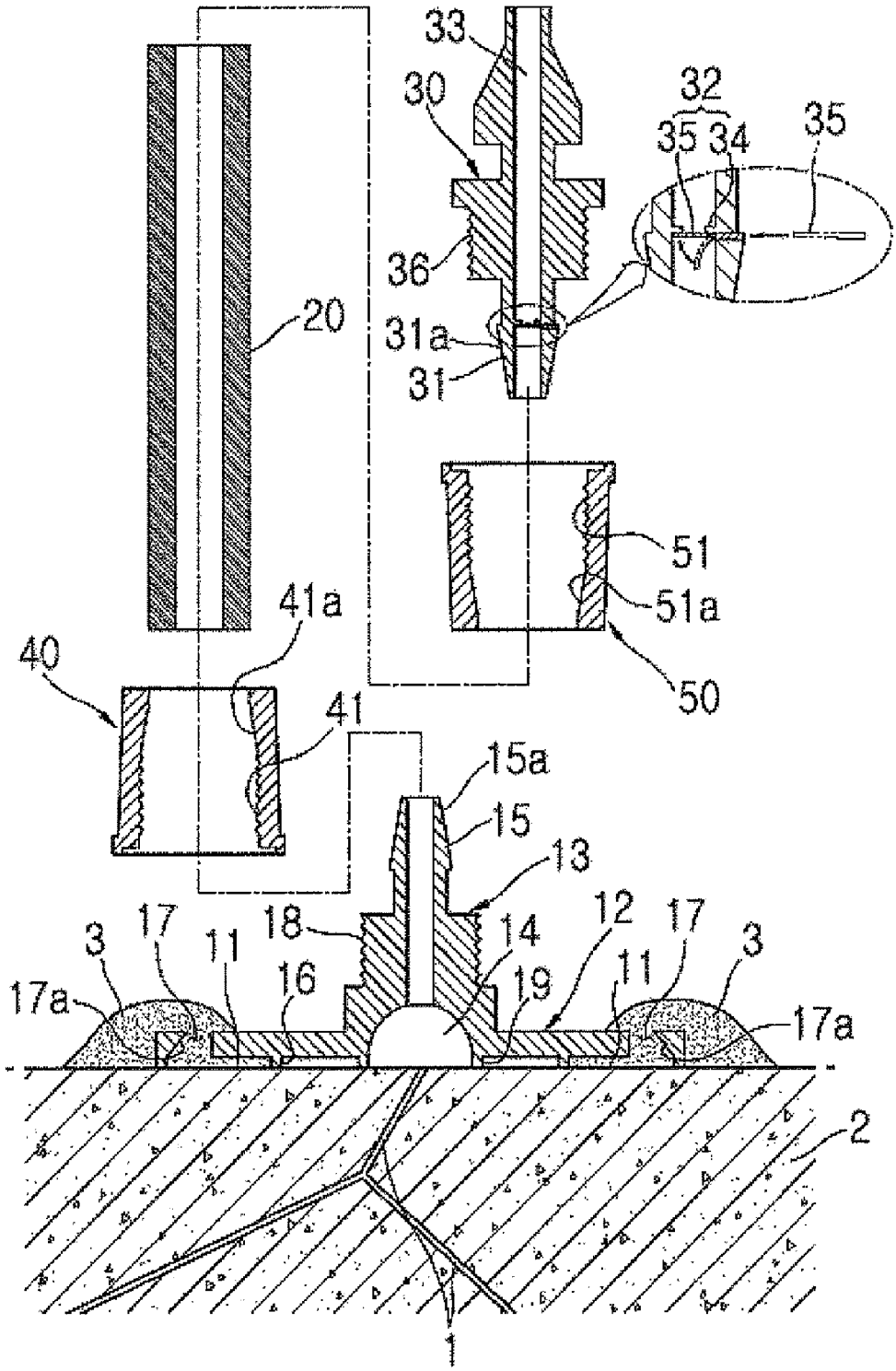
FIG. 3 is a cross-sectional view of the packer structure of FIG. 2, according to an embodiment of the present invention.
Figure 4:
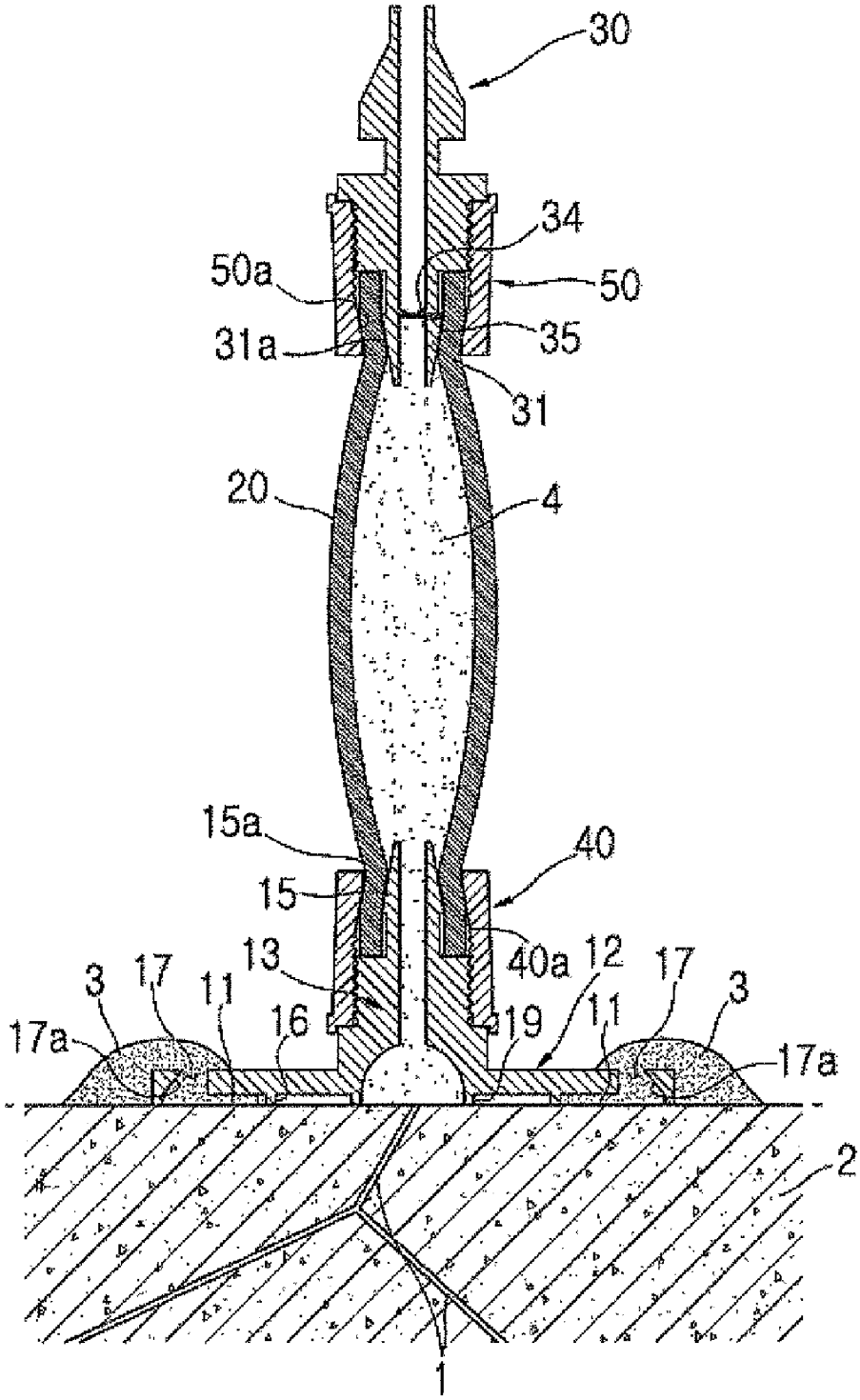
FIG. 4 is a cross-sectional view for explaining a state where a crack of a concrete structure is grouted by a packer structure for grouting, according to an embodiment of the present invention.

FIG. 2 is an exploded perspective view of a packer structure 100 for grouting according to an embodiment of the present invention. FIG. 3 is a cross-sectional view of the packer structure 100 of FIG. 2, according to an embodiment of the present invention. FIG. 4 is a cross-sectional view for explaining a state where the crack 1 of the concrete structure is grouted by the packer structure 100 for grouting, according to an embodiment of the present invention.

First, referring to FIGS. 2 and 3, the packer structure 100 includes a packer body 10, an elastic tube 20, a repair liquid injecting tube 30, a first coupling cap 40, and a second coupling cap 50.

The packer body 10 includes a flange 12 and a central tube 13.

The flange 12 is adhered onto the crack 1 by a sealer 3. A groove portion 11 accommodating the sealer 3 is formed on a lower surface of the flange 12.

The central tube 13 is a hollow tube extending upwards from a central portion of the flange 12. A first coupling portion 15 is formed at an upper portion of the central tube 13, wherein the first coupling portion 15 has an external circumference that decreases upwards, and includes a first inclined surface 15*a*. In addition, an expansion space 14 is formed at a lower portion of the central tube 13, wherein the expansion space 14 ensures a predetermined space between the central portion of the flange 12 and a structure 2. Screw threads 18 are formed on an outer circumference surface of the central tube 13.

The elastic tube 20 may inflate and deflate elastically. While the elastic tube 20 inflates, a repair liquid 4 is contained in the elastic tube 20. While the elastic tube 20 deflates, the repair liquid 4 is injected into the crack 1 by a deflation force. A first end of the elastic tube 20 is connected to the first coupling portion 15.

The repair liquid injecting tube 30 is a hollow tube in which an injecting hole 33 through which the repair liquid 4 is injected is formed. An upper portion of the repair liquid injecting tube 30 is connected to an injector (not shown). In addition, a second coupling portion 31 is formed at a lower portion of the repair liquid injecting tube 30, wherein the second coupling portion 31 has an external circumference that decreases downwards, and includes a second inclined surface 31*a*. A second end of the elastic tube 20 is connected to the second coupling portion 31. Screw threads 36 are formed on an outer circumference surface of the repair liquid injecting tube 30.

A check valve 32 for preventing the repair liquid 4 from flowing backward is coupled to the repair liquid injecting tube 30.

Figure 6:
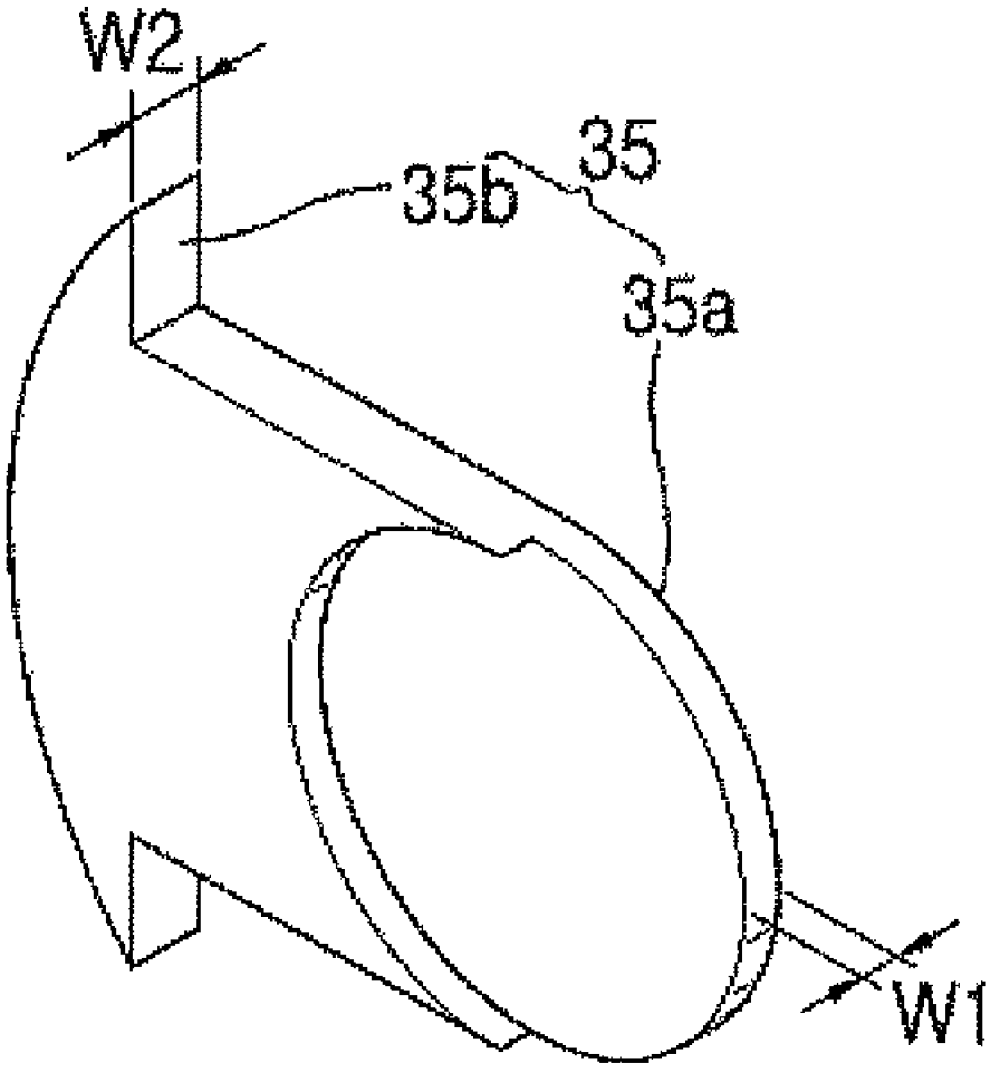
FIG. 6 is a bottom view of an elastic plate used in a packer structure for grouting, according to an embodiment of the present invention.

Referring to FIGS. 2, 3 and 6, the check valve 32 includes a stumbling projection 34 having a cyclic shape and formed on an inner circumference surface of the injecting hole 33, and an elastic plate 35 that is separately inserted into an insertion hole connected to the injecting hole 33, is formed below an outer circumference surface of the stumbling projection 34, and is elastically changed so as to close and open the injecting hole 33.

The elastic plate 35 includes an insertion portion inserted into the insertion hole, and a stumbling portion stumbled over an outer circumference surface of the injecting hole 33. A grasping groove for grasping the stumbling portion is formed on the stumbling portion. A thickness W1 of the insertion portion is smaller than a thickness W2 of the stumbling portion.

Screw valleys 41 are formed on an inner circumference surface of the first coupling cap 40. A lower portion of the first coupling cap 40 is screwed to the screw threads 18 of the central tube 13. A first pressurizing surface 40*a* is formed on an inner circumference surface of the first coupling cap 40, wherein the first pressuring surface 40*a* has an inner circumference that decreases upwards and corresponds to the first inclined surface 15*a* so as to pressurize the elastic tube 20 towards the first inclined surface 15*a*.

Screw valleys 51 are formed on an inner circumference surface of the second coupling cap 50. An upper portion of the second coupling cap 50 is screwed to the screw threads 36 of the repair liquid injecting tube 30. A second pressurizing surface 50*a* is formed on an inner circumference surface of the second coupling cap 50, wherein the second pressurizing surface 50*a* has an inner circumference that decreases downwards and corresponds to the second inclined surface 31*a* so as to pressurize the elastic tube 20 towards the second inclined surface 31*a*.

According to the present embodiment, the packer structure 100 includes a prevention projection 16 and a repair liquid diffusion prevention projection 19, which are formed on a lower surface of the flange 12. The prevention projection 16 prevents the sealer 3 from penetrating into the expansion space 14, and the repair liquid diffusion prevention projection 19 prevents the repair liquid 4 accommodated in the expansion space 14 from diffusing from the expansion space 14 towards the groove portion 11.

In addition, the packer structure 100 includes a plurality of through holes 17 formed at an edge of the flange 12 in a circumferential direction of the flange 12. The sealer 3 passes through the through holes 17 so as to be accommodated in the groove portion 11 formed below the flange 12. Each of the through holes 17 has a third inclined surface 17*a* tapered away from the structure 2. That is, an outer circumference surface of the through hole 17 increases towards the structures 12.

Hereinafter, an operation of the packer structure 100 having the above-described structure will be described.

First, elements of the packer structure 100 are assembled.

Figure 5:
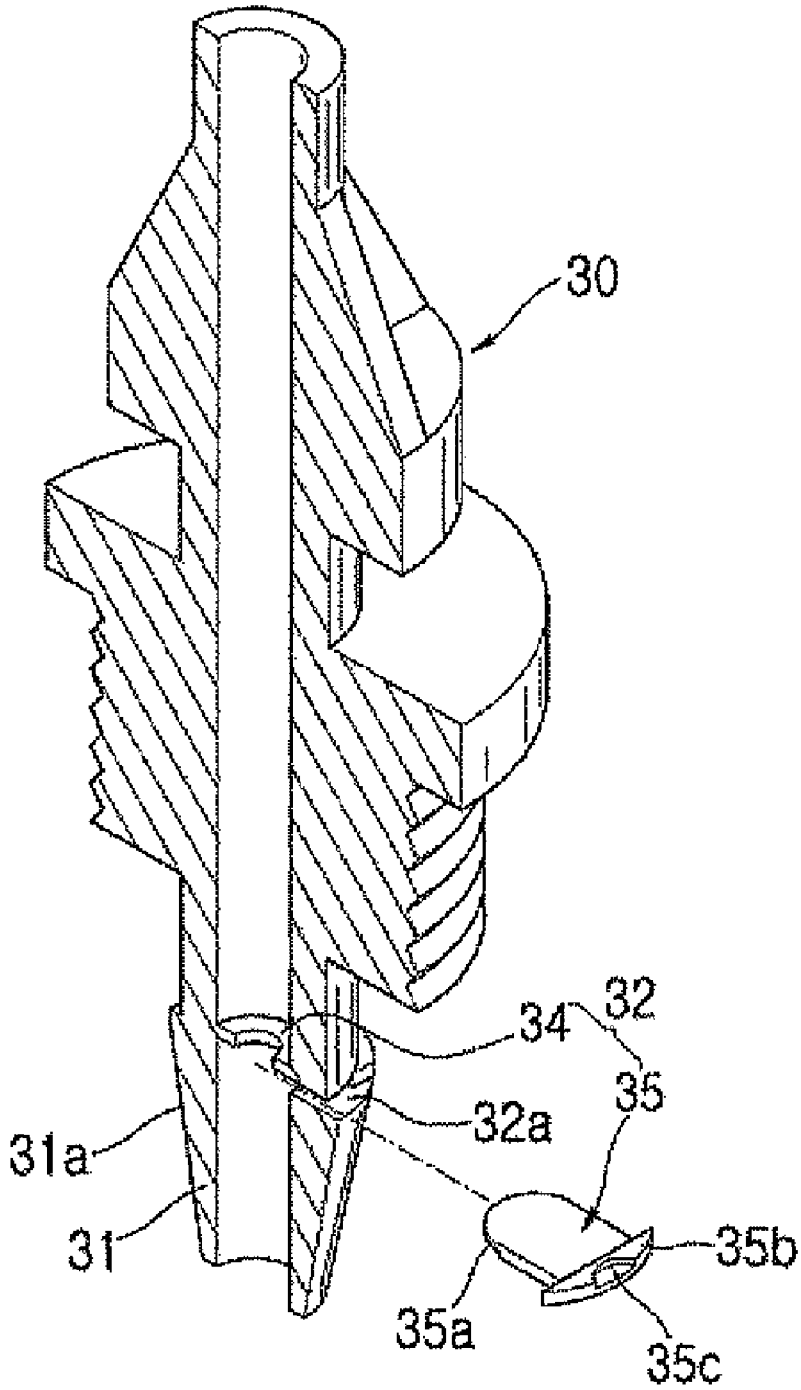
FIG. 5 is a diagram illustrating a main portion of FIG. 2, according to an embodiment of the present invention.

As illustrated in FIG. 5, the elastic plate 35 is inserted into the insertion hole formed in the repair liquid injecting tube 30 so as to be coupled to the repair liquid injecting tube 30.

Then, as illustrated in FIGS. 3 and 4, the first coupling cap 40 and the second coupling cap 50 are connected to both ends of the elastic tube 20, respectively.

The first end of the elastic tube 20, to which the first coupling cap 40 is connected, is inserted to the first coupling portion 15. Then, while tightening the first coupling cap 40 downwards, the lower potion of the first coupling cap 40 is screwed to the central tube 13 of the packer body 10.

At this time, while the first coupling cap 40 is moving downwards, the first pressurizing surface 40*a* pressurizes the elastic tube 20 towards the first inclined surface 15*a* of the first coupling portion 15, and thus the elastic tube 20 is tightened between the first coupling cap 40 and the first coupling portion 15.

The second end of the elastic tube 20, to which the second coupling cap 50 is coupled, is inserted into the second coupling portion 31 of the repair liquid injecting tube 30. Then, while tightening the second coupling cap 50 upwards, the upper portion of the second coupling cap 50 is coupled to the repair liquid injecting tube 30 between the screw valleys 51 and the screw threads 36.

At this time, like in an operation of the first coupling cap 40, while the second coupling cap 50 is moving upwards, the second pressurizing surface 50*a* pressurizes the elastic tube 20 towards the second inclined surface 31*a* of the second coupling portion 31, and thus the elastic tube 20 is tightened between the second coupling cap 50 and the second coupling portion 31.

The packer structure 100 whose elements are assembled as described above is adhered onto the crack 1 of the structure 2, as illustrated in FIGS. 1 and 4.

The sealer 3 is injected at an upper side of the through holes 17 formed at the edge of the flange 12. The sealer 3 injected through the through holes 17 flows into the groove portion 11 formed below the flange 12 so as to adhere the flange 12 onto the crack 1 of the structure 2.

At this time, the prevention projection 16 formed on the lower surface of the flange 12 prevents the sealer 3 from diffusing and penetrating into the expansion space 14 so as to previously prevent the sealer 3 from clogging the expansion space 14.

Then, the repair liquid 4 is injected into the injecting hole 33 by the injector. While the elastic plate 35 is elastically changed downwards by a pressure used to inject the repair liquid 4, the injecting hole 33 is opened, and the repair liquid 4 inflates the elastic tube 20 so as to be accommodated in the elastic tube 20.

At this time, the expansion space 14 accommodates the repair liquid 4 so as to reduce a back pressure of the repair liquid 4. When the repair liquid 4 is injected into the crack 1 by a deflation force of the elastic tube 20, the repair liquid diffusion prevention projection 19 prevents the repair liquid 4 from diffusing towards the groove portion 11 of the flange 12 so as to maintain a pressure of the expansion space 14.

Even if the repair liquid 4 flows backwards by an inner pressure of the crack 1, since the elastic plate 35 is stumbled by the stumbling projection 34 having a circular shape, the repair liquid 4 does not leak through the injecting hole 33. At this time, even if a force for separating the flange 12 from the structure 2 acts therebetween due to the back pressure of the repair liquid 4, the third inclined surface 17*a* of the through hole 17 disperses the force so as to prevent the flange 12 from being separated from the structure 2.

As a time elapses, the elastic tube 20 deflates, and thus the repair liquid 4 is injected into the crack 1. Then, when the repair liquid 4 is injected into the crack 1, the elastic tube 20 deflates, and then the repair liquid 4 is injected again, and thus the crack 1 is grouted.

In the packer structure 100 according to the present embodiment, the elastic tube 20 is easily coupled to the central tube 13 and the repair liquid injecting tube 30 by the first coupling cap 40 and the second coupling cap 50. In addition, the first and second pressuring surfaces 40*a* and 50*a* of the first and second coupling 40 and 50 pressurize the elastic tube 20 towards the first and second coupling portions 15 and 31, respectively, and thus the repair liquid 4 may be previously prevented from leaking from the both ends of the elastic tube 20.

The check valve 32 for preventing the repair liquid 4 from flowing backwards includes the elastic plate 35 that is elastically changed, and the stumbling projection 34 preventing the elastic plate 35 from being upwards and the injecting hole 33 from being opened, and thus the repair liquid 4 may be easily and effectively prevented from flowing backward.

The elastic plate 35 is separately inserted into the insertion hole connecting the injecting hole 33 to the outside, and thus the elastic plate 35 may be easily coupled. In addition, when the elastic plate 35 needs to be replaced, since the elastic plate 35 may be picked out from the injecting hole 33 by the grasping groove of the stumbling portion, the elastic plate 35 may be easily coupled and replaced In the elastic plate 35, the thickness of the insertion portion is smaller than the thickness of the stumbling portion, wherein the stumbling portion protrudes downwards from an imaginary line extending from a lower surface of the insertion portion by a thickness difference between the stumbling portion and the insertion portion.

Thus, since an elastic change of the insertion portion may be easily performed in a lower direction from a state where the injecting hole 33 is closed, compared to in an upper direction, the repair liquid 4 may be effectively prevented from flowing backward.

The prevention projection 16 formed on the lower surface of the flange 12 may previously prevent the sealer 3 from penetrating into the expansion space 14, and the third inclined surface 17*a* of the through hole 17 may effectively disperse a force due to the back pressure of the repair liquid 4 so as to prevent the flange 12 from being separated from the structure 2.

In the packer structure 100 according to the present embodiment, the first coupling cap 40 and the second coupling cap 50 are screwed to the first and second coupling portions 15 and 31 at the both ends of the elastic tube 20, thereby obtaining improved assembly. In addition, the both ends of the elastic tube 20 are pressurized by the first and second coupling caps 40 and 50, thereby preventing the repair liquid 4 from leaking from the both ends of the elastic tube 20.

Second, the check valve 32 for preventing the repair liquid 4 from flowing backward includes the elastic plate 35 and the stumbling projection 34. The elastic plate 35 is elastically changed in a direction in which the injecting hole 33 for injecting the repair liquid 4 by using a pressure is opened, and is stumbled by the stumbling projection 34 while the elastic plate 35 is elastically changed in a direction in which the injecting hole 33 is closed due to a back pressure generated when the repair liquid 4 flows backward, thereby easily and effectively preventing the repair liquid 4 from flowing backward.

Third, since the elastic plate 35 is separately inserted into the insertion hole connecting the injecting hole 33 to the outside, and thus the elastic plate 35 may be easily coupled. In addition, when the elastic plate 35 needs to be replaced due to the damage of the elastic plate 35, since the elastic plate 35 may be picked out from the injecting hole 33, the packer structure 100 may be easily repaired.

Fourth, the prevention projection 16 formed on the lower surface of the flange 12 prevents the sealer 3 from diffusing and penetrating into the expansion space 14 so as to previously prevent the sealer 3 from clogging the expansion space 14.

Fifth, the outer circumference surface of the through hole 17 for adhering the flange 12 to the sealer 3 tapers, and thus the back pressure of the repair liquid 4 (corresponding to the force to separate the flange 12 from the structure 2) is dispersed on the third inclined surface 17*a* of the through hole 17, thereby strongly adhering the flange 12 to the structure 2.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A packer structure for grouting which is used to inject a repair liquid into a crack of a concrete structure, the packer structure comprising:

a packer body comprising:

a flange adhered onto the crack by a sealer, wherein a groove portion accommodating the sealer is formed on a lower surface of the flange; and a central tube that is a hollow tube extending upwards from a central portion of the flange, wherein a first coupling portion is formed at an upper portion of the central tube, has an external circumference that decreases upwards, and comprises a first inclined surface;

an elastic tube having a first end connected to the first coupling portion, wherein the elastic tube inflates and deflates elastically, a repair liquid is contained in the elastic tube while the elastic tube inflates, and the repair liquid is injected into the crack by a deflation force;

a repair liquid injecting tube comprising:

a second coupling portion connected to a second end of the elastic tube, having an external circumference that decreases downwards, and comprising a second inclined surface; and a check valve coupled to the repair liquid injecting tube and preventing the repair liquid from flowing backward;

a first coupling cap having an inner circumference surface of a lower portion screwed to the central tube, wherein a first pressurizing surface is formed on an inner circumference surface of an upper portion of the first coupling cap so as to pressurize the elastic tube towards the first inclined surface; and a second coupling cap having an inner circumference surface of an upper portion screwed to the repair liquid injecting tube, wherein a second pressurizing surface is formed on an inner circumference surface of a lower portion of the second coupling cap so as to pressurize the elastic tube towards the second inclined surface, wherein the check valve comprises:

a stumbling projection having a circular shape and formed on an inner circumference surface of the injecting hole; and an elastic plate that is separately inserted into an insertion hole connected to the injecting hole, is formed below an outer circumference surface of the stumbling projection, and is elastically changed so as to close and open the injecting hole.

2. The packer structure of claim 1, wherein the elastic plate comprises:

an insertion portion inserted into the insertion hole; and a stumbling portion stumbled over an outer circumference surface of the injecting hole, wherein the stumbling projection comprises a grasping groove for grasping the stumbling portion.

3. The packer structure of claim 1, further comprising: a prevention projection formed on a lower surface of the flange and preventing the sealer from penetrating into the expansion space.

4. The packer structure of claim 1, further comprising: a plurality of through holes formed at an edge of the flange in a circumferential direction of the flange, wherein the sealer passes through the plurality of through holes, and each of the plurality of through holes comprise a third inclined surface tapered away from the concrete structure so that an outer circumference surface of each of the plurality of through holes increases towards the concrete structure.

* * * * *